US010532585B2

(12) United States Patent
Friedrich et al.

(10) Patent No.: US 10,532,585 B2
(45) Date of Patent: Jan. 14, 2020

(54) HIGH-TURNAROUND, CLOSED-LOOP, DIRECT TO GARMENT PRINTING

(71) Applicant: 240 Tech LLC, Santa Ana, CA (US)

(72) Inventors: Kris Otto Friedrich, La Quinta, CA (US); Blair Kristine Dorsey, San Juan Capistrano, CA (US); Qixiang Li, Shenzhen (CN); Tongze Tang, Shenzhen (CN); Shuzhang Liao, Shenzhen (CN); Chao Zhang, Shenzhen (CN)

(73) Assignee: 240 Tech LLC, Santa Ana, CA (US)

( * ) Notice: Subject to any disclaimer, the term of this patent is extended or adjusted under 35 U.S.C. 154(b) by 0 days.

(21) Appl. No.: 16/235,609

(22) Filed: Dec. 28, 2018

(65) Prior Publication Data

US 2019/0217632 A1 Jul. 18, 2019

Related U.S. Application Data

(63) Continuation of application No. 15/847,003, filed on Dec. 19, 2017, now Pat. No. 10,189,278, which is a (Continued)

(51) Int. Cl.
*B41J 13/00* (2006.01)
*B41J 11/00* (2006.01)

(Continued)

(52) U.S. Cl.
CPC ..... *B41J 3/4078* (2013.01); *B41J 2/01* (2013.01); *B41J 11/002* (2013.01); *B41J 11/0015* (2013.01); *B41J 13/0009* (2013.01)

(58) Field of Classification Search
CPC .... B41J 13/103; B41J 13/0009; B41J 11/002; B41J 11/007; B41J 11/06; B41J 11/0085; B41J 2/01

(Continued)

(56) References Cited

U.S. PATENT DOCUMENTS 5,765,476 A 6/1998 McKeever
6,096,475 A 8/2000 Hare et al.

(Continued)

FOREIGN PATENT DOCUMENTS

CN 304341074 S 11/2017
CN 107487070 A 12/2017

(Continued)

OTHER PUBLICATIONS

Co-pending U.S. Appl. No. 16/432,273, filed Jun. 5, 2019.

(Continued)

*Primary Examiner* — An H Do

(74) *Attorney, Agent, or Firm* — Wilson Sonsini Goodrich & Rosati

(57) ABSTRACT

In one embodiment, a high-speed, closed-loop fabric printer comprises a plurality of consecutive stations that can be managed by a single operator. In particular, shirts or other fabric garments may be individually loaded and secured on a pallet by an operator, and the loaded pallets may then cycle through a plurality of unmanned stations positioned along a contiguous path (e.g., oval). The stations may be configured for pretreating the fabric surface, drying and pressing the pretreated fabric with heat, and then inkjet printing a selected image, among others. In this manner, a "wet-to-dry-to-wet" direct to garment (DTG) printing process may thus be achieved, along with optimal controls for maximum adaptability. Furthermore, due to the closed-loop design, a recently printed fabric product returns to the operator to be unloaded at the position in which a new unprinted fabric is loaded, allowing for increased throughput and minimal operator requirements.

20 Claims, 11 Drawing Sheets

Related U.S. Application Data continuation of application No. 15/810,497, filed on Nov. 13, 2017, now abandoned.

(60) Provisional application No. 62/556,059, filed on Sep. 8, 2017.

(51) Int. Cl.
*B41J 3/407* (2006.01)
*B41J 2/01* (2006.01)

(58) Field of Classification Search
USPC ..... 347/1–4, 101, 102, 104
See application file for complete search history.

(56) References Cited

U.S. PATENT DOCUMENTS

| | | | |
|---|---|---|---|
| 7,040,748 | B2 | 5/2006 | Niimi et al. |
| 7,413,301 | B2 | 8/2008 | Niimi et al. |
| 7,498,277 | B2 | 3/2009 | Pace et al. |
| 7,765,927 | B1 | 8/2010 | Liu et al. |
| 7,997,677 | B2 | 8/2011 | Navazo et al. |
| 8,092,003 | B2 | 1/2012 | Sloan |
| 9,050,220 | B2 | 6/2015 | Digiacomantonio et al. |
| 9,611,401 | B2 | 4/2017 | Mozel et al. |
| 9,707,133 | B2 | 7/2017 | Digiacomantonio et al. |
| 9,849,665 | B2 | 12/2017 | Livingston |
| 10,131,160 | B2 | 11/2018 | Hoffman et al. |
| 10,189,278 | B1 | 1/2019 | Friedrich et al. |
| 2006/0152568 | A1 | 7/2006 | Niimi et al. |
| 2007/0103529 | A1 | 5/2007 | Pearl et al. |
| 2009/0097044 | A1 | 4/2009 | Zach |
| 2013/0278692 | A1 | 10/2013 | Marino et al. |
| 2015/0152274 | A1 | 6/2015 | Pearl et al. |
| 2016/0024709 | A1 | 1/2016 | Walker |
| 2016/0136978 | A1 | 5/2016 | Hamada |
| 2018/0207954 | A1 | 7/2018 | Schiestl |
| 2018/0339531 | A1 | 11/2018 | Perera et al. |

FOREIGN PATENT DOCUMENTS

| | | | |
|---|---|---|---|
| CN | 107574697 | A | 1/2018 |
| CN | 207432996 | U | 6/2018 |
| EP | 2509791 | B1 | 10/2013 |
| WO | WO-2019041487 | A1 | 3/2019 |
| WO | WO-2019051190 | A1 | 3/2019 |

OTHER PUBLICATIONS

FLEXcon Company, Inc. Flexcon Develops Breakthrough UV Inkjet Topcoat Technology to Further Digital Printing Innovation. Available athttps://www.flexcon.com/about/news-events/news-releases/dpm-uvij. Accessed on Sep. 24, 2019.

Images Magazine. Schulze Pretreatmaker. 360 Communications Ltd. Website. Jun 26, 2017. 3 pages. URL:< https://images-magazine.com/schulze-pretreatmaker/>.

Kornit Avalanche Platform—Industrial printing platform for high volume and quick turnaround. Available at https://cloud.3dissue.com/122286/122537/143531/AVALANCHREV6/index.html. Accessed on Sep. 25, 2019.

Kornit Digital. Kornit Allegro: Roll to Roll Printer. Web page. Kornit Digital, Copyright 2019. Accessed Apr. 1, 2019. 6 pages. URL:< https://www.kornit.com/k-solution/allegro/.

PCT/US2018/049898 International Search Report and Written Opinion dated Oct. 18, 2018.

PCT/US2018/049898 Third party observation submitted by Anonymous; dated Aug. 20, 2019.

PCT/US2018/049898 Third party observation submitted by Anonymous; dated Jun. 13, 2019.

PCT/US2018/049898 Third party observation submitted by Hirsch; dated Aug. 10, 2019.

PCT/US2019/035541 International Search Report and Written Opinion dated Aug. 12, 2019.

ROQ. Automatic Screen Printing Machines. ROQ. Website. Accessed Apr. 3, 2019. 4 pages. URL:< http://roqinternational.com/solutions/screen-printing-machines/.

ROQ. ROQprint Oval Pro. ROQ. Website. Accessed Apr. 3, 2019. 13 pages. URL:< http://roqinternational.com/product/screen-printing-machines/roqprint-oval-pro/.

Schulze. PRETREATmaker Line. Walter Schulze GmbH. Website; Accessed Jul. 1, 2019. 3 pages. URL:< http://www.pretreatmaker.com/line-en.html>.

U.S. Appl. No. 15/847,003 Notice of Allowance dated Oct. 4, 2018.

U.S. Appl. No. 15/847,003 Notice of Allowance dated Sep. 14, 2018.

U.S. Appl. No. 15/847,003 Office Action dated Mar. 9, 2018.

HIGH-TURNAROUND, CLOSED-LOOP, DIRECT TO GARMENT PRINTING

CROSS-REFERENCE TO RELATED APPLICATION

This application is a continuation of U.S. patent application Ser. No. 15/847,003, filed Dec. 19, 2017, which is a continuation of U.S. patent application Ser. No. 15/810,497, filed Nov. 13, 2017, which claims the benefit of U.S. Provisional Patent Application Ser. No. 62/556,059, filed Sep. 8, 2017, each entitled "HIGH-TURNAROUND, CLOSED-LOOP, DIRECT TO GARMENT PRINTING", by Friedrich et al., the disclosures of each of which are incorporated herein by reference in their entirety.

TECHNICAL FIELD

The present disclosure relates generally to fabric printing, and, more particularly, to high-turnaround, closed-loop, direct to garment printing.

BACKGROUND

Screen printing or "silk-screening" is a printing technique that has been around for centuries in which a mesh is used to transfer ink onto a substrate (e.g., paper or fabric), except in areas made impermeable to the ink by a blocking stencil. Typically, a blade or squeegee is moved across the screen to fill the open mesh apertures with ink and press the screen onto the substrate, such that the ink wets the substrate where not blocked by the stencil, leaving the ink behind when the screen is removed from the substrate. One color (or a single mixture of colors) is printed at a time so that several screens can be used to produce a multicolored image or design.

Enhancements to silk-screening have occurred over time, such as rotary multi-screen manual systems, automated silk-screening assembly lines, continuous rotating cylinder printing, and others (e.g., heat transfer vinyl (HTV) or transfer printing). However, more recent advancements in technology have adapted inkjet printing for fabrics (e.g., tee shirts), allowing for greater flexibility in design and processing. For example, colorful pictures and intricate patterns can easily be created and transferred to a fabric surface in high resolution through computerized ink jets with various colored inks in a process typically referred to in the art as "direct to garment" (DTG) inkjet printing. However, inkjet printing on fabrics still presents various issues, and there remains room for improvement in terms of image quality and production speed.

SUMMARY

The techniques described herein relate generally to high-turnaround, closed-loop, direct to garment (DTG) printing. Specifically, according to one or more embodiments of the present disclosure, a high-speed, closed-loop (e.g., oval) fabric printer comprises a plurality of consecutive stations that can be managed by a single operator and is capable of producing as many as 300 printed shirts per hour. In particular, shirts or other fabric garments may be individually loaded and secured on a pallet by an operator, and the loaded pallets may then cycle through a plurality of unmanned stations positioned along a contiguous path (e.g., oval). The stations may be configured for pretreating the fabric surface, drying and pressing the pretreated fabric with heat, and then inkjet printing a selected image, among others. In this manner, a "wet-to-dry-to-wet" DTG printing process may thus be achieved, along with optimal controls described herein for maximum adaptability. Furthermore, due to the closed-loop design, a recently printed fabric product returns to the operator to be unloaded at the same or adjacent position in which a new unprinted fabric is loaded, allowing for increased throughput and minimal operator requirements.

Other various specific embodiments are described in detail below, and the summary is not meant to be limiting to the present disclosure.

BRIEF DESCRIPTION OF THE DRAWINGS

The embodiments herein may be better understood by referring to the following description in conjunction with the accompanying drawings in which like reference numerals indicate identically or functionally similar elements, of which.

DESCRIPTION OF EXAMPLE EMBODIMENTS

Figure 1:
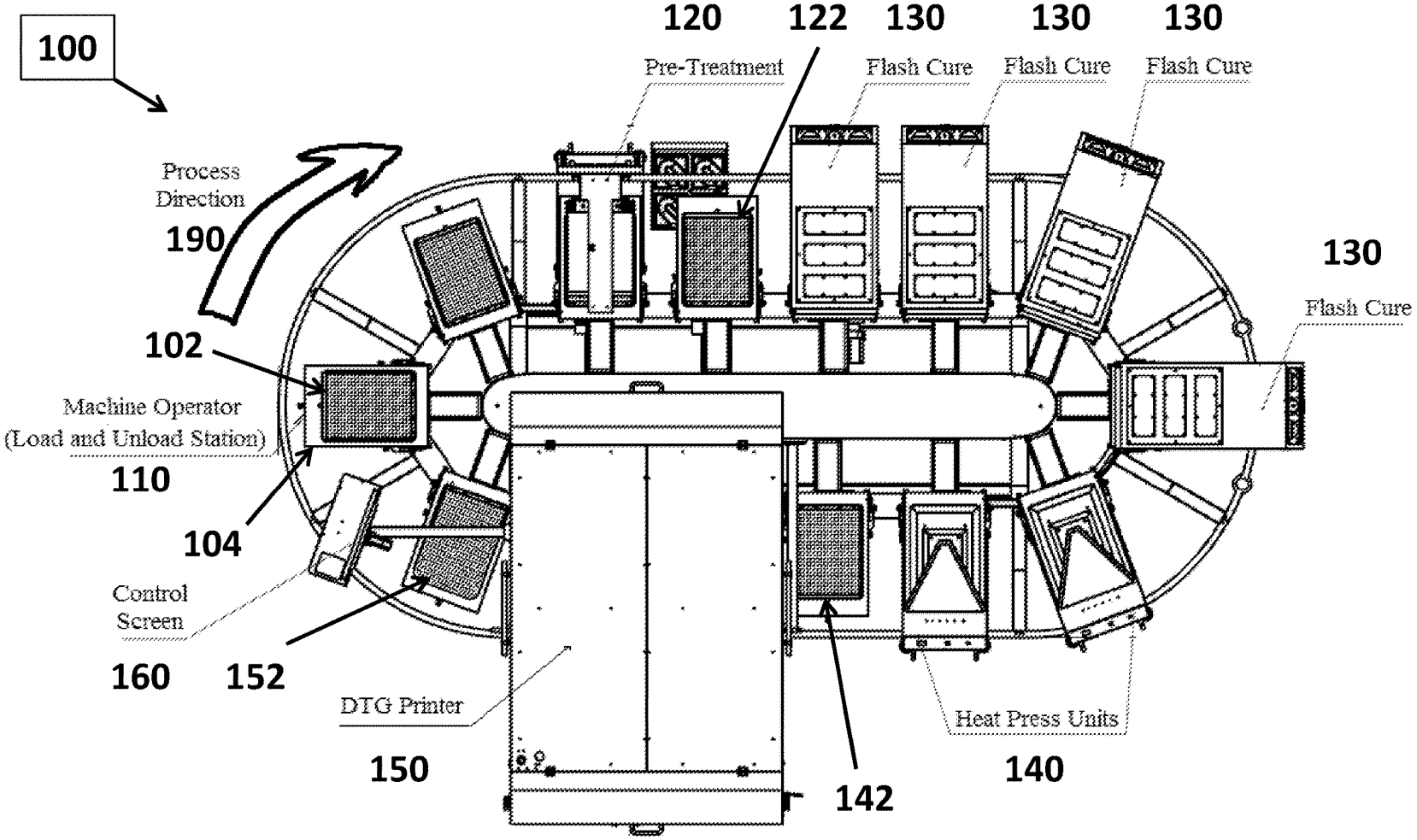
FIG. 1 is an overhead view of an apparatus for high-turnaround, closed-loop, direct to garment printing.
Figure 2:
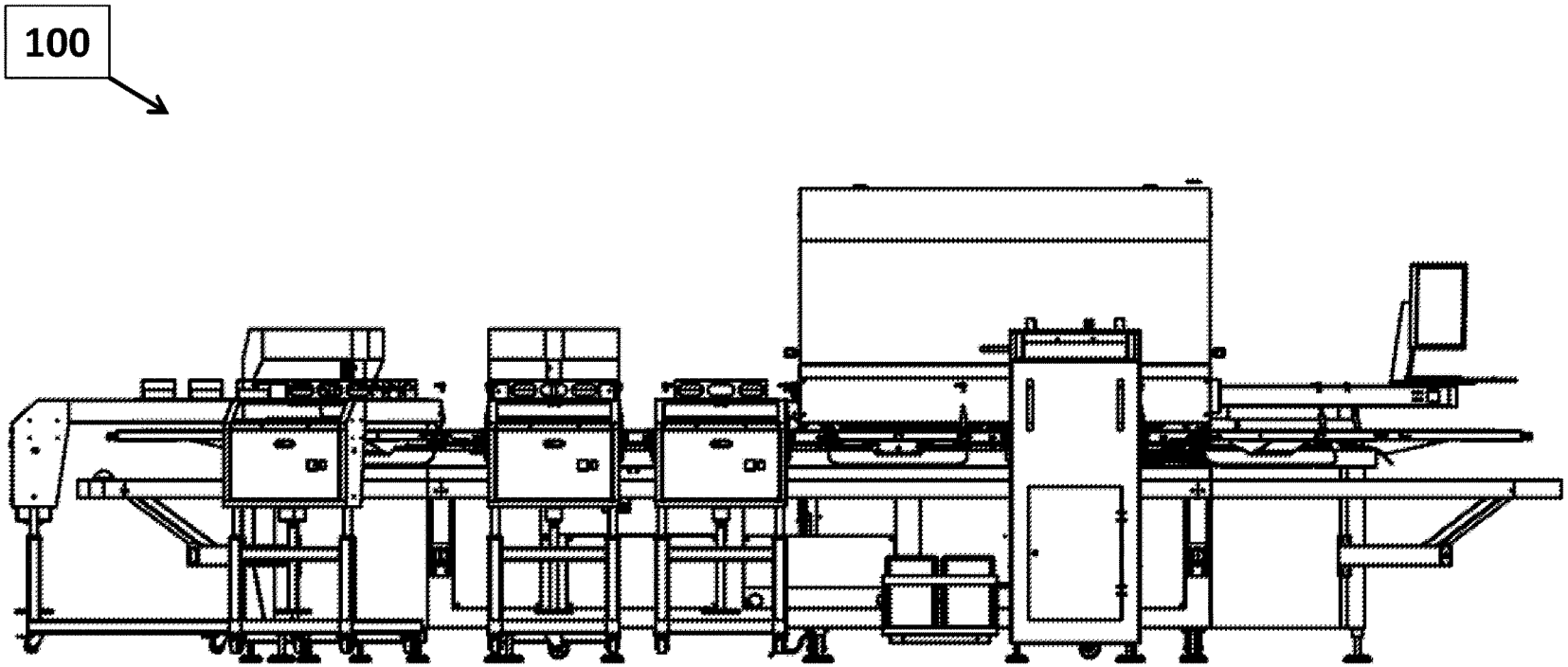
FIGS. 2-5 are side views of an apparatus for high-turnaround, closed-loop, direct to garment printing.
Figure 3:
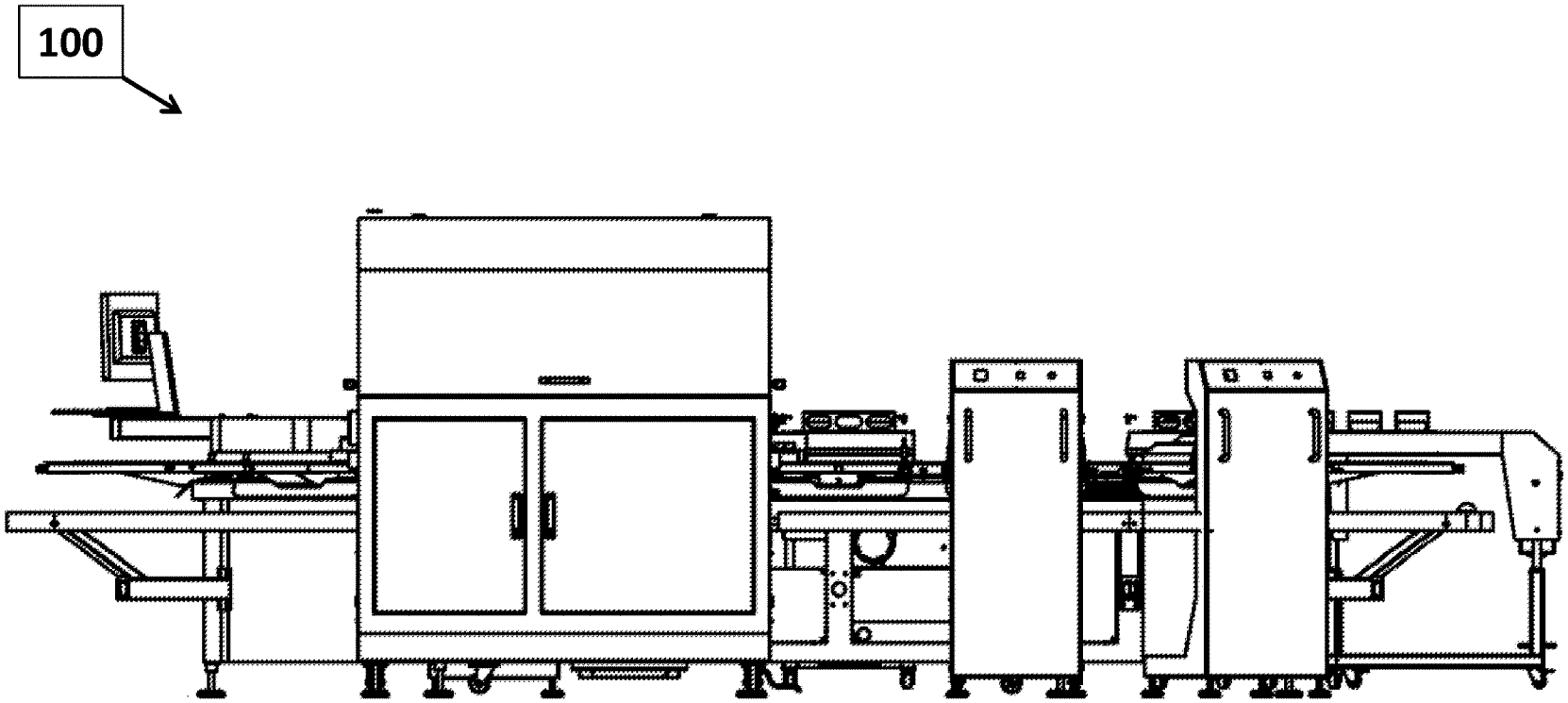
Figure 4:
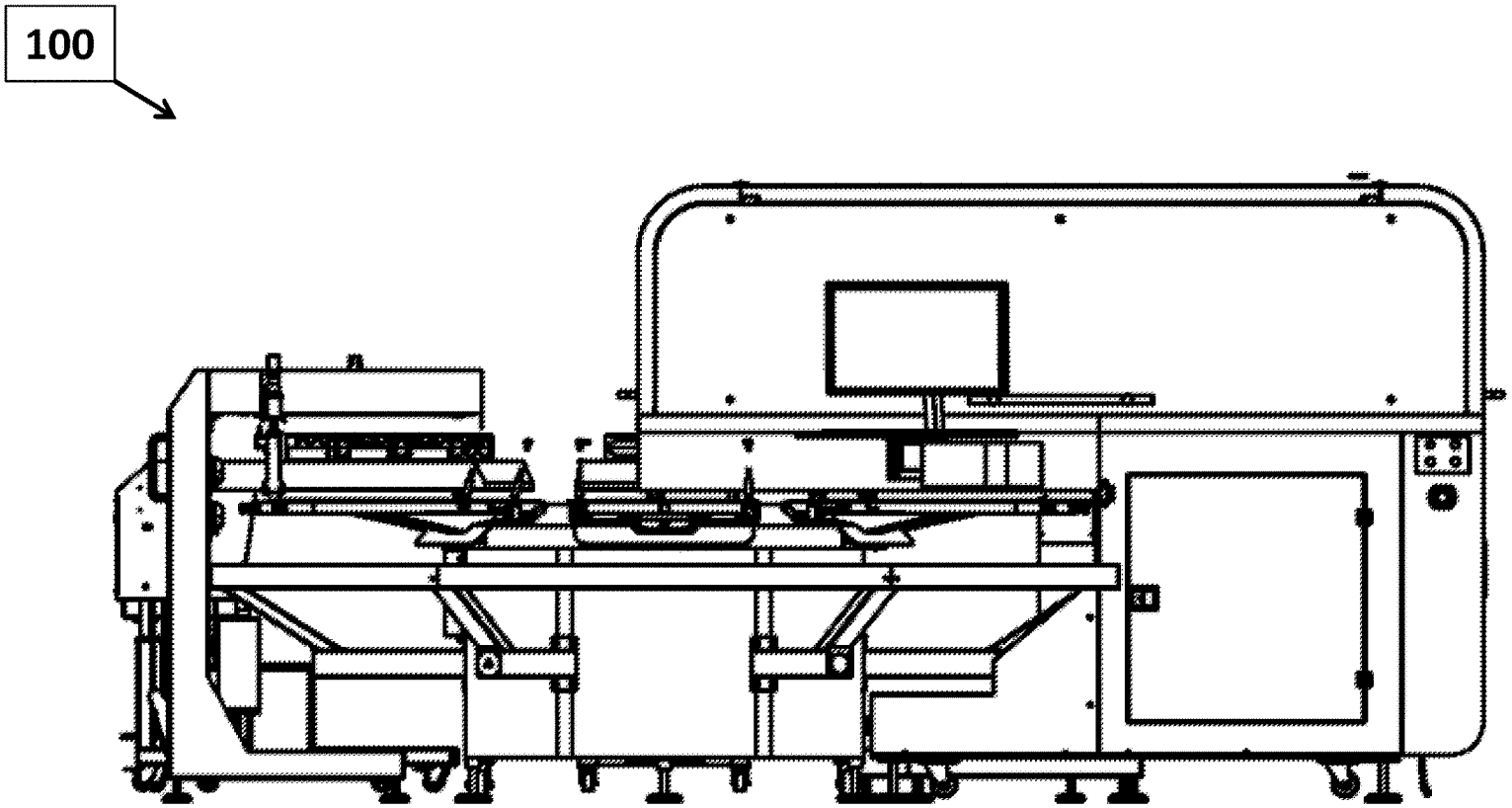
Figure 5:
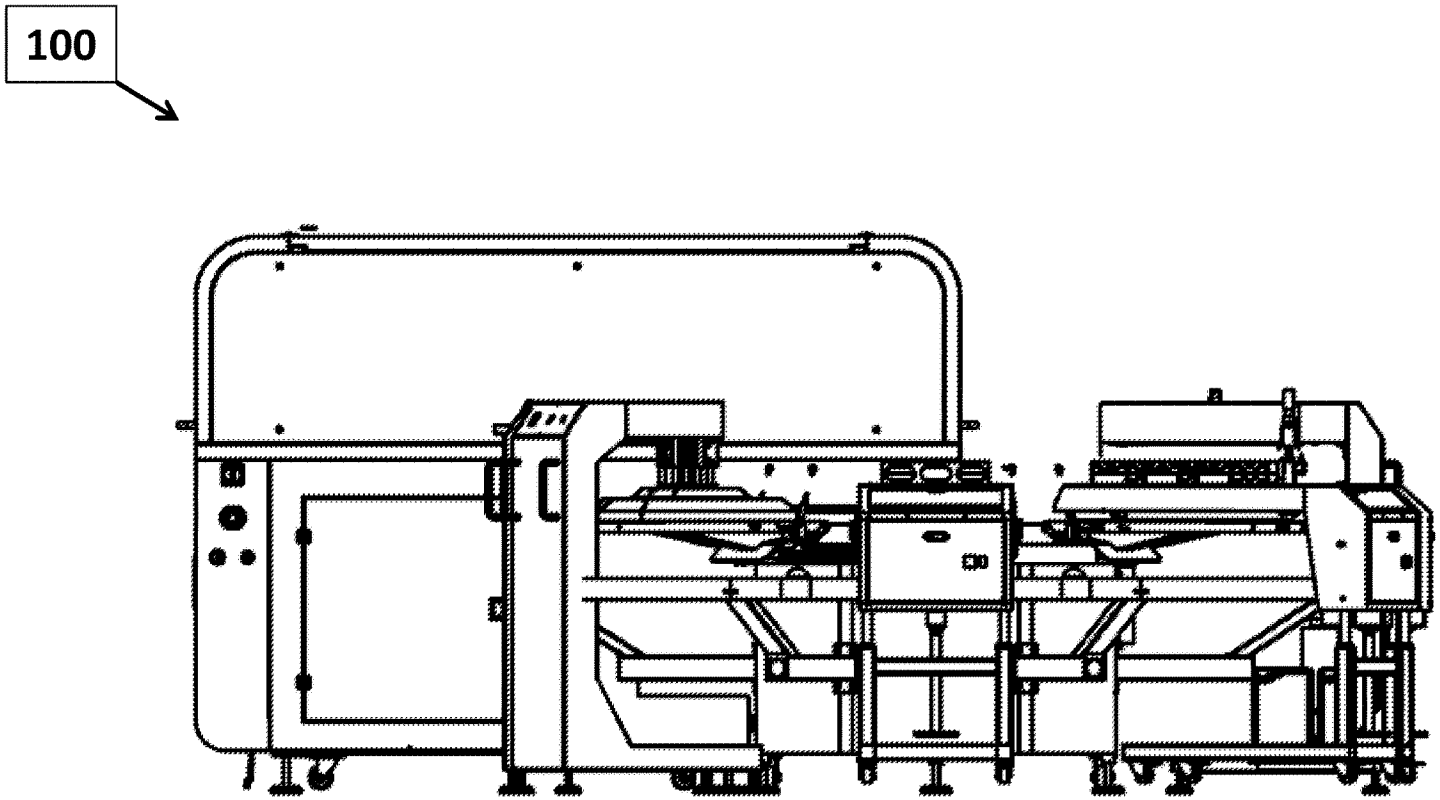
Figure 6:
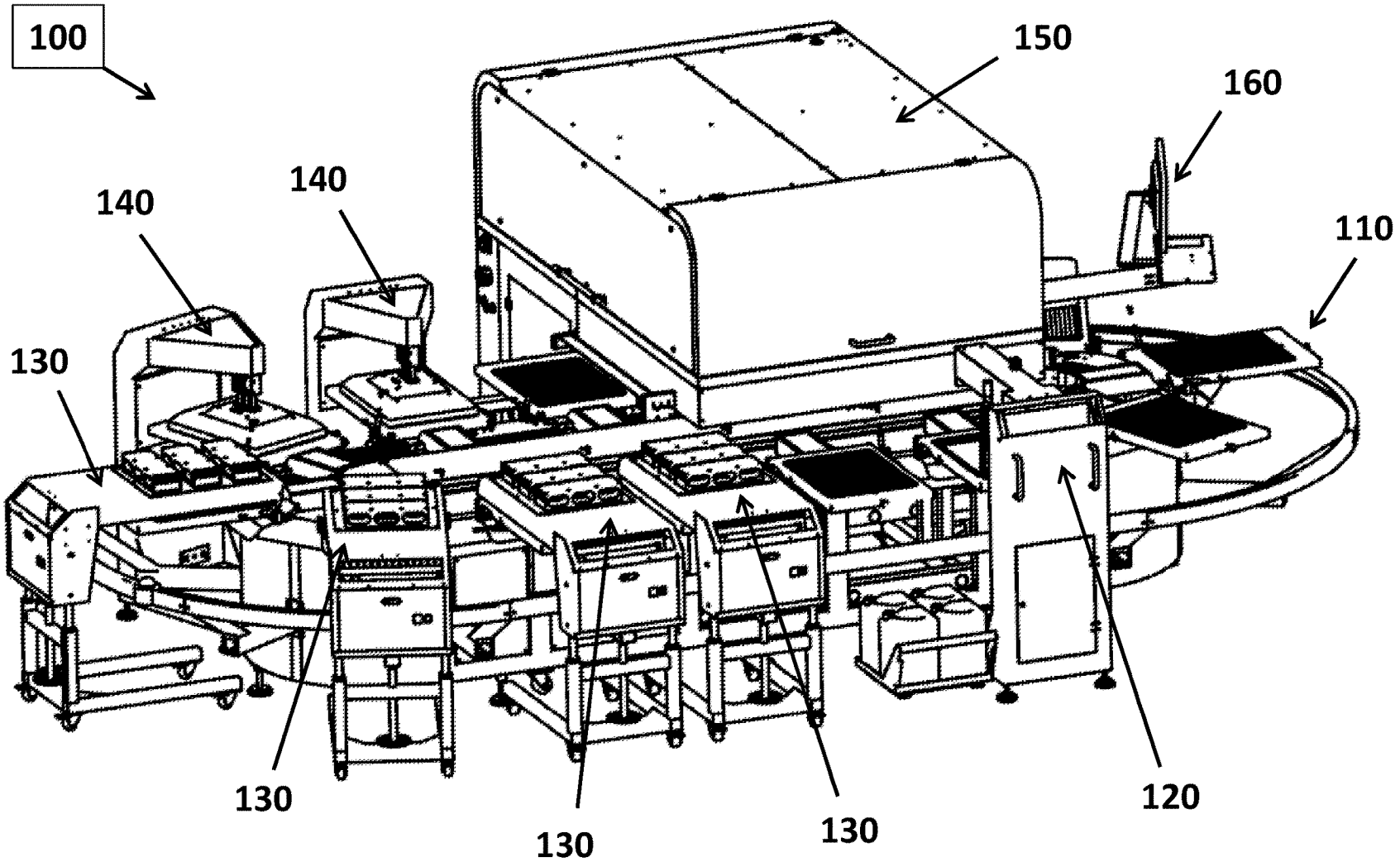
FIG. 6 is a perspective view of an apparatus for high-turnaround, closed-loop, direct to garment printing.

As mentioned above, recent technological improvements have adapted direct to garment or "DTG" printing to print very high quality, full color, photographic prints on just about any textile substrate (e.g., fabrics, canvas, tee shirts, etc.). However, inkjet printing on fabrics is still limited with regard to resolution and throughput, especially in combination.

For instance, DTG printing techniques often require pretreating the substrate, particularly darker colored fabrics, with a chemical primer solution in order to achieve consistent and even printing. Proper application of the pre-treatment solution helps to obtain optimum absorption levels and ink adhesion to the fabric while also minimizing lateral bleeding, which may impact color, opacity, definition, and intensity.

Currently, pretreating techniques falls into two categories, referred to comparatively herein as "wet-on-dry" (WD) and "wet-on-wet" (WW). In wet-on-dry systems, the substrate is first pretreated either manually or by a pretreatment machine, and then dried, typically manually using a dryer and/or heat press. Later, the already pretreated (and dried) substrate is placed into the DTG printer for image printing with inks (hence "wet-on-dry"). In wet-on-wet systems, on the other hand, a printer typically first applies (e.g., by spraying) a pretreatment solution onto the substrate ("wet"), and then quickly (i.e., before it has a chance to dry) inkjet prints ("wet") the colored image onto the wet substrate. Wet-on-wet systems are generally fully integrated direct in-line processes, where an operator inserts an untreated garment, and then the pretreating and ink printing occur one after another within the same DTG printer. Notably, in both systems (WD and WW), it is common to first print a layer of white as a base layer upon which the colored image may then be printed.

Wet-on-dry systems are a multi-step process requiring time for drying between multiple stages of operation, often needing multiple workers or dividing a worker's time among different machines). WD systems generally also require storage of pretreated (and dried) garments and typically have a generically pretreated area on the garment (e.g., a full rectangle of "printable" area) regardless of the actual image to be printed. On the other hand, wet-on-wet systems may only be single-step processes (one worker inserting an untreated garment into the printer and removing a completed product). However, WW processes require very careful chemical coordination between the pretreat solution and ink and may still result in the two applications mixing together and smearing the printed image. Both systems also are designed for minimal production runs (e.g., typically up to 100 or so garments per customer order), since the DTG printers in both systems are only configured to print one (up to four) garments at a time (i.e., a worker places a garment in the printer, waits for it to print, removes the garment from the printer, inserts a new garment into the printer, waits for that garment to print, and so on).

The techniques described herein alleviate the concerns mentioned above, providing high-turnaround, closed-loop, DTG printing. Specifically, according to one or more embodiments as described in greater detail below, a high-speed, closed-loop (e.g., oval) fabric printer comprises a plurality of consecutive stations that can be managed by a single operator. As detailed below, fabric substrates, such as shirts or other fabric garments, may be individually loaded and secured on a pallet by the operator, and the loaded pallets then cycle through a plurality of unmanned stations positioned along a contiguous path. The stations may be configured for pretreating the fabric surface, drying and pressing the pretreated fabric with heat, and then inkjet printing a selected image, among others demonstrated further herein. In this manner, a newly established "wet-to-dry-to-wet" DTG printing process may thus be achieved. Due to the closed-loop design of the contiguous path (illustratively oval, although other options are also possible), a recently printed fabric product returns to the operator to be unloaded at the same or directly adjacent position in which a new unprinted fabric substrate (e.g., garment) is loaded, allowing for increased throughput and minimal operator requirements (e.g., single operator operation). The techniques herein also provide for optimal controls and coordination between the stages of the system, allowing for maximum adaptability (e.g., for ink compositions, fabric materials, fabric thicknesses, image resolutions, and so on).

Reference is made generally to FIGS. 1-10 below, illustrating example embodiments of high-turnaround, closed-loop, direct to garment printing in accordance with various aspects of the techniques herein.

In general, as shown, a single operator can both load untreated fabric substrates (e.g., garments) into the printing machine and unload printed garment products from the machine. Since the process is a continuously operating loop, pallets move between sequential stations, stopping at each for a preset period of time. Illustratively, the pallets move in tandem and the distance between consecutive stations is generally the same, such that the garment "sits" at each station for the same amount of time. Generally the dwell time at each process station may be dictated by a rate-limiting step of the overall process. However, this may not always be the most time-consuming step of the printing process, which is typically drying a treated/printed fabric. For example, the time spent at each station may generally be set by the amount of time needed to print the image on the garment, since increased need for drying time can be managed by increasing the number of drying stations positioned along the path, as discussed below.

The overall process begins with choosing a specific design for a final printed image, its features (e.g., colors, resolution, size, etc.), and a type of fabric garment on which the image is to be printed. These together typically dictate printing conditions (such as number of print passes, number and type of print heads, ink composition, pretreating conditions, etc.), which determine both the overall printing rate and the speed at which the garment passes through each station. Note that in certain embodiments, this may also affect the cost for the batch of final printed garments, as thicker fabrics or higher quality images will generally require more processing time and thus less of a throughput. For example, the garment may be made of a variety of different types of fabrics, such as cotton or synthetics, and may also vary in thickness and in size. Larger, thicker garments may require greater loading times, printing times, and/or drying times. In addition, the desired printed image, such as the image design, image size, color scheme, and the target location on the garment, may also impact the overall process time and the time spent within each process station. Note that pallet design may also be modified as needed for certain types of garments in order to improve overall process efficiencies.

Selected image details and printing conditions are programmed into a color printer, and a printing time is established. From this, the number and types of process stations along the continuous oval process loop can be determined, and each process station can be programmed to achieve a desired result within the established preset process station time, as described below. Once the printer is programmed, the dwell time in the stations is set, and the process stations are positioned, the overall continuous printing process can begin.

With reference to FIGS. 1-6, printing apparatus 100 comprises a plurality of pallets that are movable through a plurality of stations. The pallets stop at each station for the determined dwell time. In particular, at operator station 110, an operator may load fabric substrate 102 (e.g., a garment, such as a t-shirt or sweatshirt) onto pallet 104 and secures it into place (such as by lowering a pallet frame onto the garment and latching it into position). The garment is positioned so that the surface onto which the image is to be printed is face up, thereby providing a window to access the printable surface. As a specific example, a shirt can be loaded, with the neck facing the operator stationed along the outside of the oval track. Smoothing of the printable surface can also occur, either automatically or manually by the operator, prior to securing the fabric in place. The shirt is loaded and secured at the operator station within the established process station time (the dwell time).

The resulting loaded pallet then passes, as shown by process direction arrow 190, from operator station 110 to one or more pretreatment stations 120. Once stopped at this station, another shirt may be loaded by the operator onto a subsequent empty pallet at operator station 110. At pretreatment station 120, a pretreatment fluid (e.g., a pretreatment solution, such as an acidic pretreatment) can be applied to the target printable surface as needed. The amount of pretreatment, type of solution, and method of application can be varied depending, for example, on the type of garment, the type and color of fabric, and the image design. For example, for a white or light colored cotton tee shirt, no pretreatment may be needed, depending on ink compositions and fabric type, but for darker colors or thicker fabrics, pretreatment may be preferred. In some embodiments, pretreatment occurs using a nozzle sprayer to apply an acidic pretreatment solution to the printable surface. Alternatively, the acidic pretreatment solution may be applied using a screen printing techniques. However, nozzle spraying may be preferred since screening methods generally require refilling of the solution reservoirs after application, which would necessitate the addition of another operator or at least would require attention from the loading/unloading operator. In addition, nozzle spray printing enables targeting of specific portions of the printable surface so that only the areas that require pretreatment (e.g., the areas to which the target image will be printed) receive treatment. For either method, a single pass is often sufficient to apply the pretreatment solution to the printable surface. In this way, pretreatment can occur in the required process station time, thereby enabling higher speeds of the overall process. However, if more time is needed to apply the required amount of pretreatment, such as for thicker fabric garments, rather than increasing the dwell time at the station (which would necessarily increase the time in all stations), one or more additional pretreatment stations may be added, thereby having minimal impact on the overall process timing.

The pallet containing the resulting fabric substrate having the pretreated printable surface 122 (e.g., a pretreated fabric garment) then passes to one or more heating stations 130 (e.g., flash drying stations) at which heat is applied to dry and set the pretreatment. Any flash drier known in the art may be used, including those used to dry silk screened images. For example, in some embodiments, the flash drier includes an infrared heater. The number of flash drying stations depends, for example, on the type of fabric, the drying temperature, and the amount of time needed to thoroughly set and dry the pretreated fabric at that temperature. These may be determined experimentally or estimated empirically. The required drying time is then compared to the previously determined constant dwell time to be spent at each process station, and the number of needed flash driers can then be determined. For example, for drying a single-pass nozzle-pretreated cotton shirt at a preset temperature, four sequential flash drier stations may be used, as shown in FIGS. 1-6. Each heating station 130 may be programmable so that the temperature can be turned on prior to the pallet entering the station or may employ a temperature ramp to reach the desired drying temperature within the preset time. Also, each station may flash dry and set the pretreated fabric at the same average temperature, or each stage may use a different temperature, such as increasing or decreasing temperature steps, to achieve efficient heating without damage to the fabric.

As an illustrative example, assume that printing a target image on a t-shirt (at a later stage in the process, although a stage that another previously loaded t-shirt may currently be undergoing) takes 10 seconds. To ensure proper drying of the pre-treatment solution, it may be determined that, at a specified temperature X, it would take approximately 40 seconds to apply the desired amount of heat. As such, assuming the t-shirt dwells at each station for only 10 seconds (as dictated by the printing time), one solution would be to use four flash cure stations (10 seconds for 4 stations equals 40 seconds). Alternatively, heat may be increased and fewer flash cure stations may be used (e.g., 3 stations for a total of 30 seconds, at a higher drying temperature). Other combinations will be readily apparent to those skilled in the art, and those mentioned herein are merely for illustration of the adaptiveness of the system described herein.

After flash drying, the pallet containing the fabric substrate having the dried pretreated printable surface 132 (e.g., a dried pretreated fabric) may then pass to one or more optional hot press stations 140 at which, during the pre-established station dwell time, the fabric fibers are pressed in preparation for image printing. The number of hot press stations can be varied, depending, for example, on the temperature of the hot press and on the number of flash drying stations (e.g., the extent of drying of the pretreated fabric). It has been found that by using one or more hot press stations as an additional heating station for further heating and drying the pretreated fabric, overall drying time can be significantly reduced (e.g., one third the dry time required by only flash curing the garment), thereby improving efficiency and overall production speed, in addition to stretching and pressing the fibers of the fabric (which makes for better printing).

In this specific embodiment, the pallet containing the resulting fabric substrate having the pressed dried pretreated printable surface (e.g., a pressed dried pretreated fabric) then passes to one or more printer stations 150, such as a DTG printer, where ink is applied to produce the printed fabric product including the desired image. While many different types of printers may be used, in some embodiments the printer comprises an inkjet printer, which may be any inkjet printer known in the art. Inkjet ink compositions may be white or color inks (such as cyan, magenta, yellow, or black), including pigment based or dye based colorants, and are formulated for the particular type of print head and nozzles in order to enable high speed printing of the chosen image onto the pressed dry pretreated fabric.

The number of print heads and nozzles may be chosen as needed in order to provide a final printed image in a time that is less than or equal to the preset station dwell time, as discussed in more detail herein. In particular, the number of print heads may be chosen to ensure that the entire image is capable of being printed in a single pass within the preset time. However, for some image designs, resolutions (e.g., higher dots per inch (DPI)), and fabric types, multiple passes of the print head may be needed. Multiple passes would either require increasing the station dwell time, which would reduce overall throughput (e.g., 50 garments per hour), especially for large batch operations, since all stations (e.g., pretreatment, flash drying, and hot pressing) would also include the increased time, or, alternatively, would produce a lower quality final printed image (durability, clarity, etc.) if a single pass is used (e.g., 300 or more garments per hour). Notably, as mentioned above, in some embodiments, the print station dictates the time spent at each station (the dwell time), and as such, also dictates the amount of heat that needs to be applied (temperature and/or number of heat/cure stations) in order to dry the pre-treatment solution sufficiently enough to be ready for printing.

Figure 7:
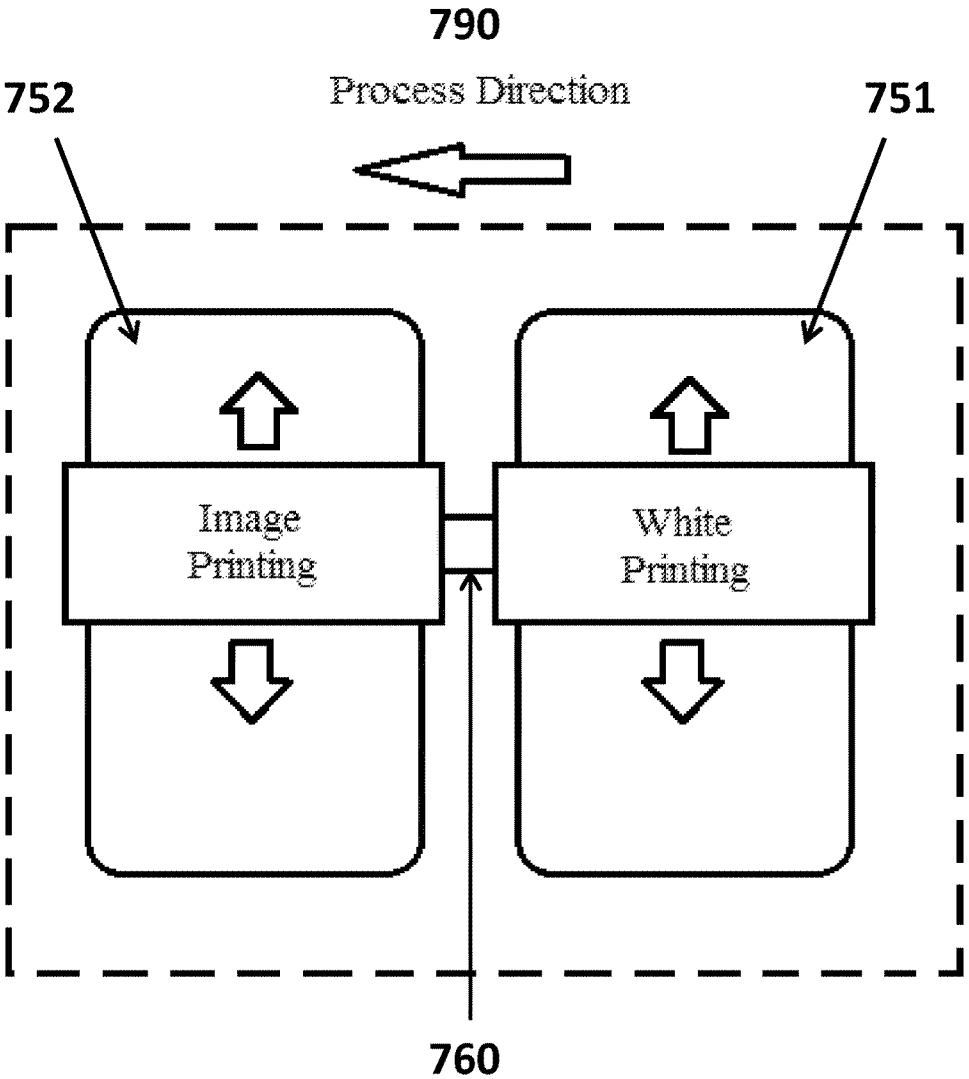
FIG. 7 is an example simplified view of a printer stage of an apparatus for high-turnaround, closed-loop, direct to garment printing.

Therefore, in order to achieve high throughput in a single pass, based on the techniques described herein, it has been found that multiple consecutive printer stations can be used, with each station being configured to print a specific type of ink within the preset station dwell time. For example, as shown in FIG. 7, in some embodiments, the pallet containing the pressed dry pretreated fabric may pass in direction 790 through two consecutive and adjacent printer stations, 751 and 752. First printer station 751 may include an array of print heads configured for printing a first inkjet ink, and second printer station 752 may include an array of print heads configured for printing a second inkjet ink. In some embodiments, the array of print heads are linear (such as a linear array of eight print heads), and each array having a length that spans across the entire print area (e.g., across the width of print area of the fabric garment).

The print head of the first station may move independently of the print head of the second station, or, alternatively, the print heads of each station may be configured to move in tandem (e.g., on a single controlled arm 760). For example, the print heads of consecutive printer stations may be mechanically coupled so that a single pass may be made for all print heads while sequential pallets are positioned in adjacent printer stations. Note that, in this configuration, the print heads of each station need not apply ink on each "pass". For example, if six passes at the first station are required, but only four passes at the second station are required, the ink jets of the second station may be configured to not apply ink for at least two of the passes. The same arrangement is possible in reverse as well: that is, fewer ink application passes on the first station than the second station. This would be expected to significantly simplify the mechanical design and operation of the printer, saving on space, efficiency, and cost.

As shown in FIG. 7, in a specific embodiment, the first printer station may be configured for printing a white inkjet ink, and the second printer station may be configured for printing colored inkjet inks. In this way, a white base may be printed onto the pressed dry pretreated fabric within the preset time of a single stage, which is then followed by printing of the color regions needed to complete the target image, also within the preset time and within a single stage. Accordingly, the white ink composition may be specifically formulated to dry (set up) quickly in order to allow proper application of the colored image at the next printing station.

Illustratively, as shown in FIG. 7, in order to achieve the desired result in a single "back and forth" motion, the print heads for both the white and color stages may be arranged width-wise to cover the entire desired print area (e.g., a 16" inch array width), such that one or more back and forth passes (e.g., 20" up and back) will complete the desired printing process of the entire image without any "side to side" motion required to reposition the print heads. Note that although conventional DTG printers today typically perform around 32 "passes" (printer head passes over the garment) with white ink and 16 passes with color ink, due to the number of print head repositions, the techniques herein and the specifically configured print heads may create the same or better quality images with only 4-10 total passes (depending upon desired level of resolution).

Notably, when the first printer station (e.g., white ink) immediately follows a heating station, such as a hot pressing station, advantages may be gained by the garment still being warmed. That is, the pressed dry pretreated fabric may still be warmed due to time since the last heating of the garment, in addition to the general warming of the pallet (e.g., a metal pallet) holding the fabric over continued processing time. The white ink, printed on the heated surface, would therefore set faster (compared to being printed on a cool pre-dried surface), providing a cured surface for the color printing and increasing the speed of the overall printing process.

As mentioned above, if additional ink is needed in order to achieve the desired print quality, adjacent parallel print heads may be included in a printer station, such as an array of sixteen print heads, formed by adjacent and parallel linear arrays of eight print heads. Each linear array can be configured to print the desired color and/or combinations of colors needed to achieve the desired print quality. By using parallel arrays of print heads, additional ink can be applied without adding additional printer stations or increasing the printing time that would thereby increase the preset dwell time in each station. Illustratively, for example, if more white ink is needed for the base coat prior to printing the color image, sixteen print nozzles (e.g., two rows of eight) may be used on the white print head, and eight nozzles (e.g., a single row) may be used on the color/image print head, thus providing for twice as much ink application of white versus color within the same number of (illustratively tandem) passes of the print heads.

Figure 8:
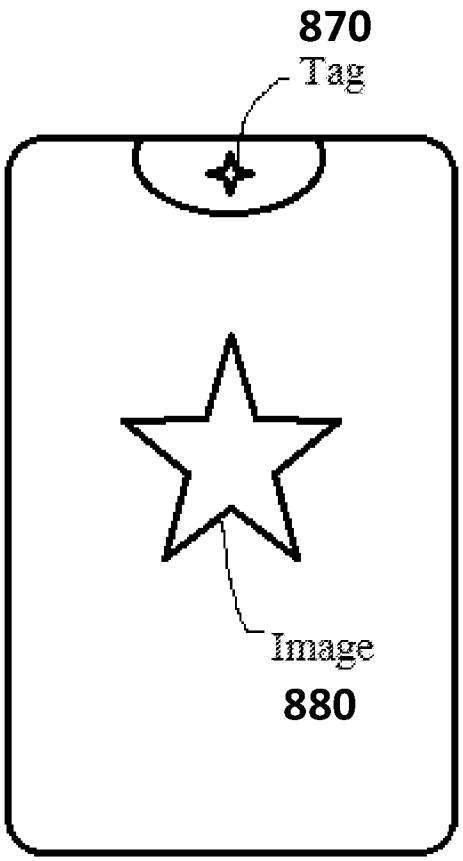
FIG. 8 is an example garment on a pallet of an apparatus for high-turnaround, closed-loop, direct to garment printing.

After the image print is complete, the pallet containing the printed fabric garment may, if needed, further pass to one or more optional heating stations to cure and set the printed image. Any of the heating stations, including the flash dry stations described above, can be used. For example, as shown in FIG. 8, in certain embodiments, the pallets may be configured to allow simultaneous print access to both the garment image-printable area and the "tag" located inside of the garment at the neck (as will be understood by those skilled in the art). For instance, many garments now replace the conventional "sewn-in" tag (manufacturer information, wash instructions, etc.) with a printing of the information. With an advanced pallet design that exposes this tag area in addition to the primary image area, the printers may be further configured to print tag 870 at the same time as image 880. In such, configurations, it may be beneficial (or required) to add one or more drying stations (e.g., one or more flash cure stations) in order to ensure that the printed neck tag has dried sufficiently enough to allow the opposing portion of the garment (e.g., the top of the shirt) to touch the neck tag without smearing it.

As shown in FIGS. 1-6, the pallet containing printed fabric product 152, in some embodiments, may then return to operator station 110, completing the circuit around the illustratively oval loop. There, the final printed fabric garment can be removed from the pallet, and a new, untreated garment can be loaded, beginning the process loop again. Note that in certain embodiments, the operator may move the garment into a follow-on drying station in order to fully cure the printed image(s), if needed. Alternatively, the pallet may return the final printed garment to a position adjacent, and within reach of, the operator at the operator station. In addition, information regarding overall process conditions and status may be provided to the operator by control screen 160. Thus, as can be seen, the entire process can be managed by a single operator, linking the components of the printing apparatus together in a customizable and programmable manner (e.g., heat, dwell time, print passes, etc.).

Figure 9:
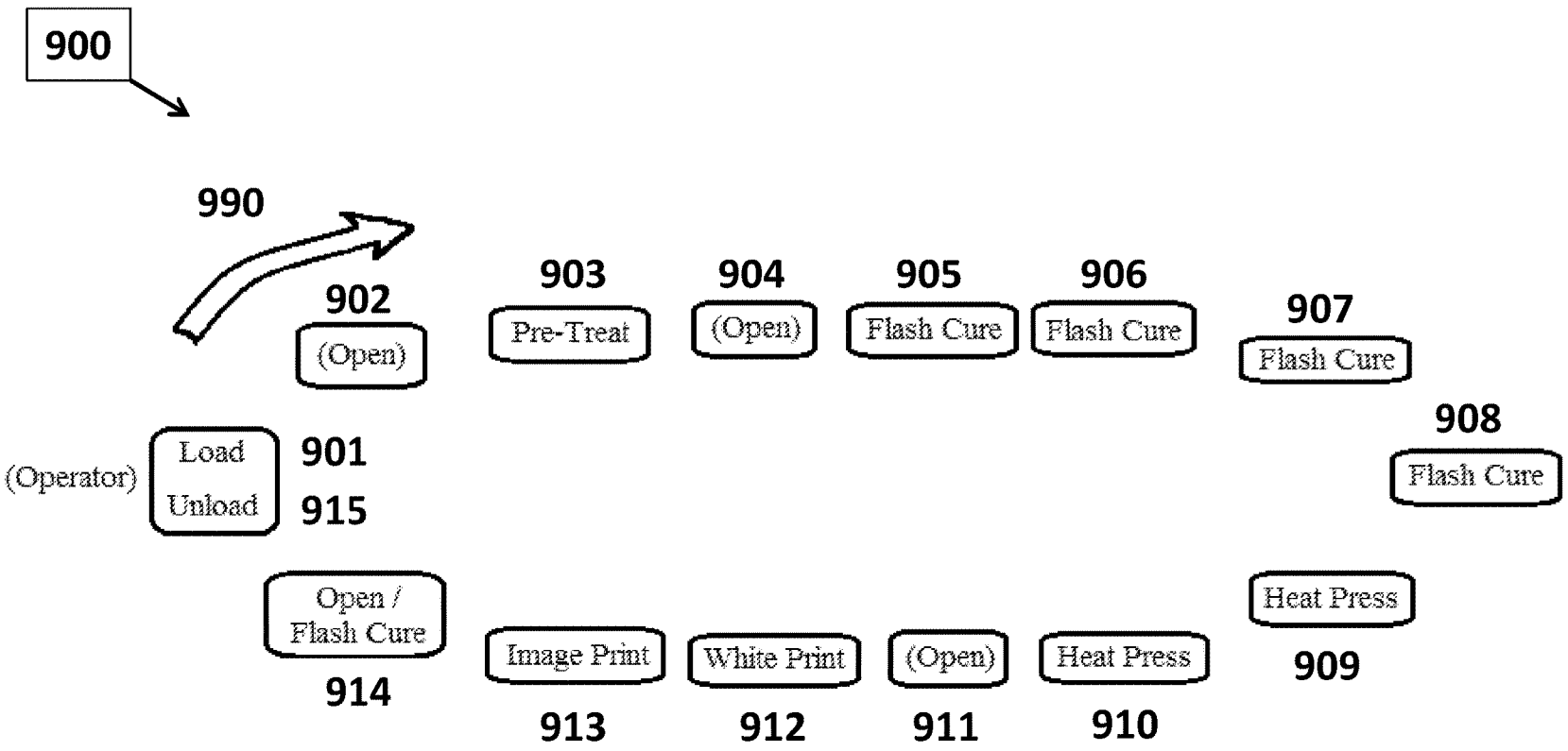
FIGS. 9 and 10 are an example simplified view of stages of an apparatus for high-turnaround, closed-loop, direct to garment printing.
Figure 10:
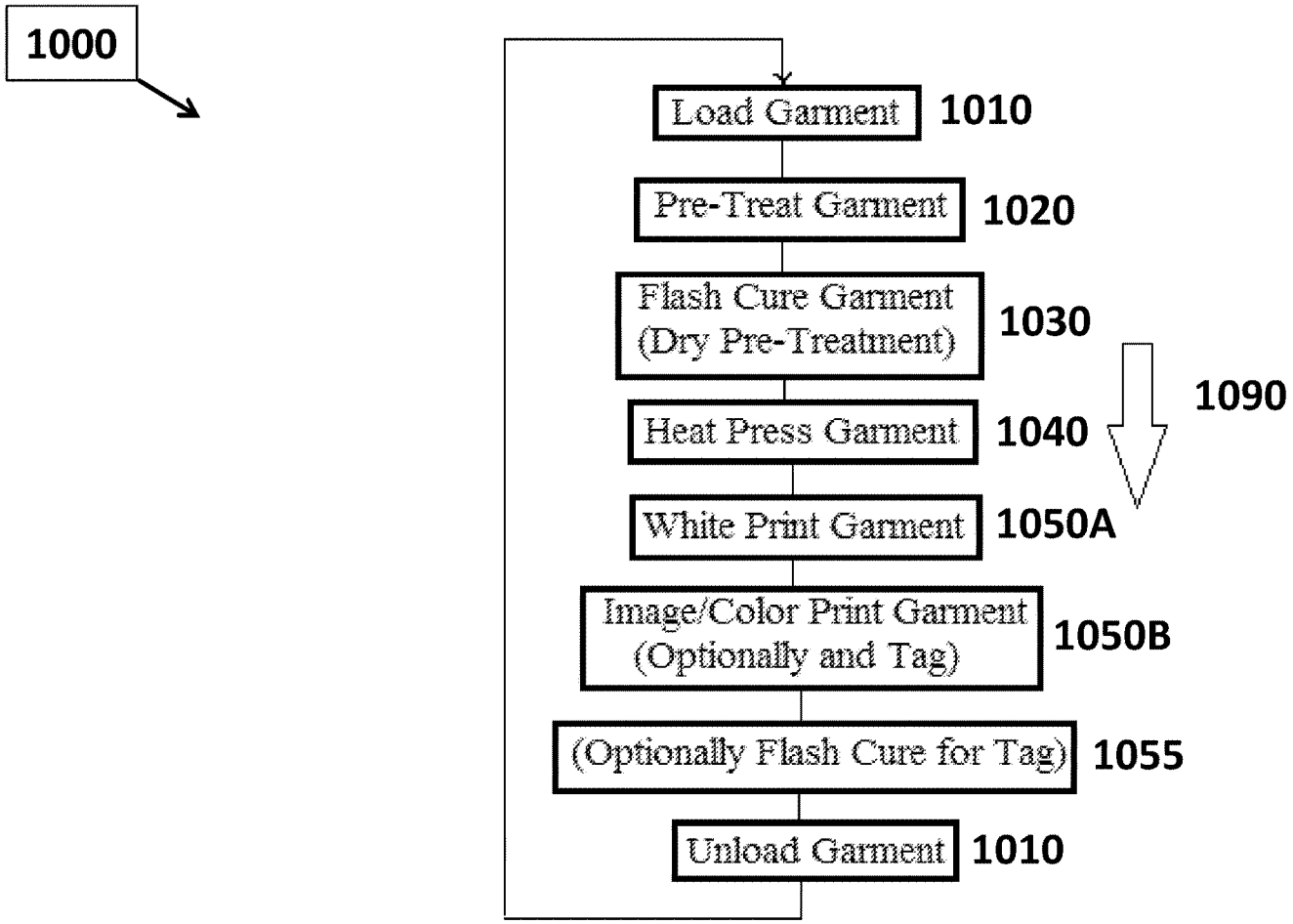

FIGS. 9-10 illustrate example procedures for high-turn-around, closed-loop, direct to garment printing in accordance with one or more embodiments described herein. For example, the steps shown may be configured for operation on the printing system described above, and controlled by a computing system which may perform the procedures by executing stored instructions.

For example, FIG. 9 illustrates general procedural steps for the illustrative system described above, with a plurality of sequential stations (such as multiple flash cure stations, and so on) at which a substrate stops for a predetermined dwell time. In particular, as shown, procedure 900 begins at operator station 901 at which an operator loads a fabric substrate onto a pallet. The loaded pallet may then move in direction 990 to first open station 902 and subsequently to pretreatment station 903 at which a portion of the printable surface of the fabric substrate may be treated, as described above. Open stations/positions may be desirable based on the distance between adjacent pallets and the relative locations of each station. After pretreatment, the pallet may then move through second open station 904 and subsequently through a series of heating stations, including flash cure stations 905-908 and heat press stations 909-910 during which the pretreated substrate surface may be dried and pressed, readied for printing. After passing through third open station 911, the pallet may then move through printing stations 912 and 913 for white and color image printing respectively. The resulting printed product may then pass through station 914, which may be an open position or a flash cure, as desired. Procedure 900 then ends at operator station 915, where the printed fabric product is unloaded. As shown, this is the same operator station where procedure 900 began.

Alternatively, FIG. 10 illustrates a more generic view, where an exact number of stations is not specifically shown, demonstrating the generalized configurability of the system described herein. As shown, procedure 1000 proceeds in direction 1090 includes operator station 1010 at which a garment may be loaded, pretreatment station 1020 to pretreat at least a portion of the area to be printed on the garment, heating stations 1030 and 1040 to flash dry and optionally hot press the pretreated garment (respectively), and printing stations 1050A and 1050B to print the image white and color ink on the pretreated portion of the garment. Optionally, at the printing station, a tag for the garment (e.g., a shirt tag) can also be printed, which can subsequently be dried at flash cure station 1055. Finally, the printed garment product may be unloaded at operator station 1010, and the process may begin again. Alternatively, in some embodiments, unloading may occur at a different operator station substantially adjacent to the station used for loading.

Figure 11:
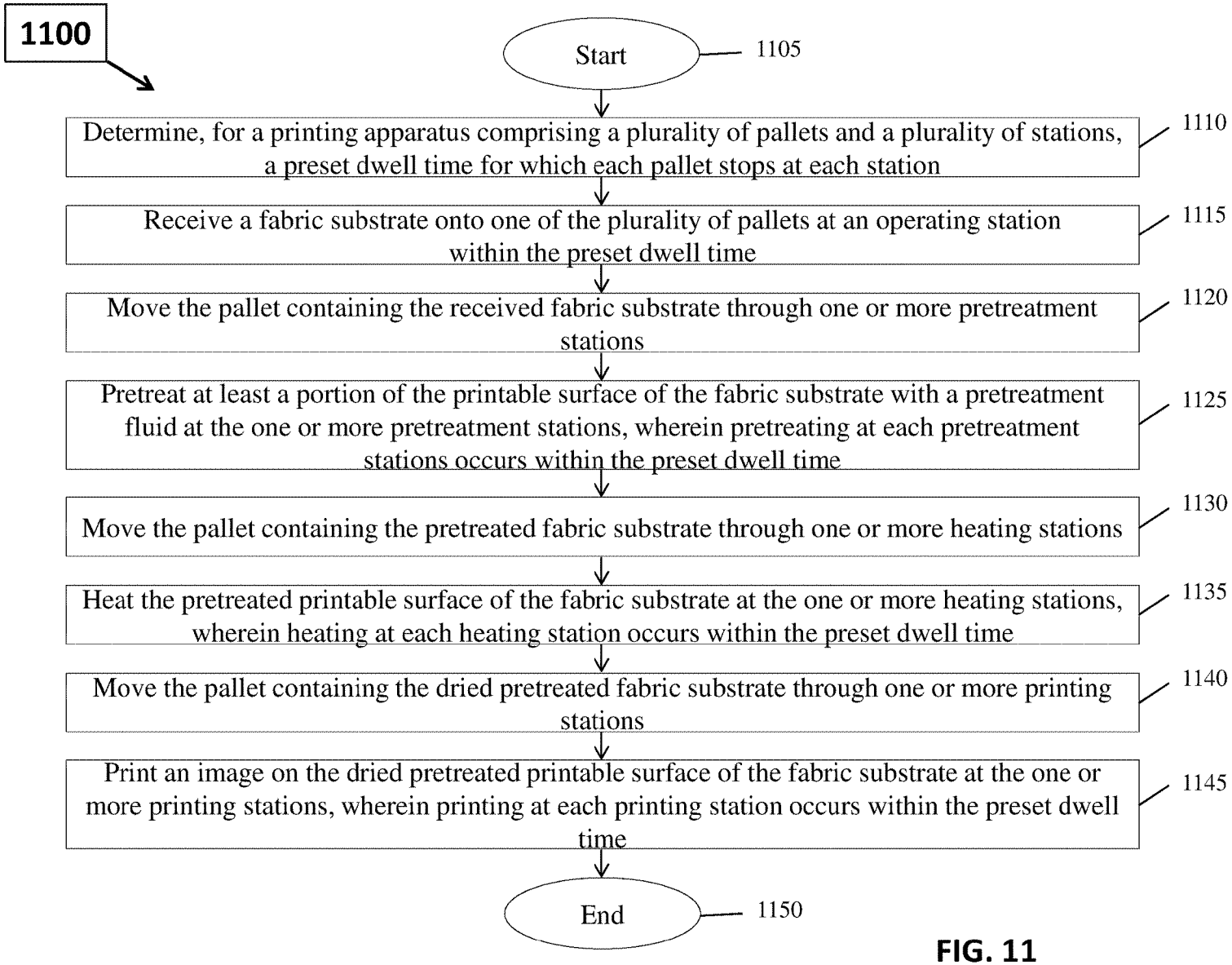
FIG. 11 shows an example simplified procedure for direct to garment printing.

FIG. 11 illustrates an example simplified procedure for direct-to-garment printing, in accordance with one or more embodiments described herein. For example, a non-generic, specifically configured device (e.g., a controller) may perform procedure 1100 by executing stored instructions. The procedure 1100 may start at step 1105, and continues to step 1110, where, as described in greater detail above, a preset dwell time is determined for a printing apparatus having a plurality of pallets that are configured to secure a fabric substrate having a printable surface and that stop at a plurality of stations positioned along a closed-loop path of the printing apparatus. The fabric substrate (e.g., a garment, such as a tee shirt or sweatshirt) is secured in the pallet to provide access to the printable surface of the substrate upon which a chosen image is to be printed. Each pallet stops at each of the stations for the preset dwell time. The dwell time may be determined based on a rate-limiting step of the process (e.g., the station requiring the most time for the fabric substrate operation) or may be determined based on which step requires more time and cannot be repeated in subsequent stations. In some embodiments, the dwell time may be pre-established/preset based on the time needed to print the chosen image on the fabric substrate.

At step 1115, the fabric substrate may be received on one of the plurality of pallets at an operator station within the preset dwell time (thus loading the fabric substrate at the operator station, such as by an operator). As described in greater detail above, loading and optionally further securing of the fabric substrate occurs within the determined preset dwell time in order to provide access to the printable surface of the fabric substrate. In some embodiments, this station may be the only manned station of the printing apparatus.

At step 1120, the pallet containing the received fabric substrate may move (e.g. sequentially) through one or more pretreatment stations. For example, as described in greater detail above, the loaded pallet may pass from the operator station to a pretreatment station comprising a nozzle jet printer configured to print an acidic pretreatment solution. Intervening open stations may also be included as needed, depending on the position of the pretreatment station and the distance between pallets.

At step 1125, as described in greater detail above, at least a portion of the printable surface of the fabric substrate may be pretreated with a pretreatment fluid at one or more of the pretreatment station, resulting in a fabric substrate having a pretreated printable surface. In some embodiments, pretreatment may occur in a single pass, although multiple passes may be needed, depending on the size of the printable area and the type of fabric. However, as described above, pretreating occurs at each of the pretreatment stations within the preset dwell time. If additional time is needed, an additional pretreatment station may be included.

At step 1130, the pallet containing the fabric substrate having the pretreated printable surface may move (e.g. sequentially) through one or more heating stations. As described in greater detail above, the number of heating stations can vary, and, in some embodiments, 2 to 5 heating stations may be used, each programmed to heat at the same or different temperature and/or rate. In particular, a certain number of heating stations may be configured, where the certain number is selected based on the amount of time needed to dry the pretreated surface and/or the chosen drying temperature, while only drying at any one heating station within the preset dwell time, as described above.

At step 1135, in some embodiments, the pretreated printable surface of the fabric substrate may be heated at the one or more heating stations, resulting in a fabric substrate having a dried pretreated printable surface. As described in greater detail above, heating at each of the heating stations occurs within the preset dwell time. The heating stations may include various types of heaters, including, for example, infrared heaters. Also, optionally, one or more of the heating stations may comprise a hot press to both heat and smooth the pretreated surface.

At step 1140, as described in greater detail above, the pallet containing the fabric substrate having the dried pretreated printable substrate may move (e.g., sequentially) through one or more printing stations. In some embodiments, multiple printing stations may be used, such as to provide a white printed image first and a color printed image on or with the white image.

At step 1145, the chosen image is printed on the dried pretreated printable surface of the fabric substrate at one or more printing stations to form a printed fabric product. In some embodiments, at least one of the printing stations comprises an inkjet printer. For example, white inkjet ink may be printed onto the fabric substrate surface followed by printing of color inkjet ink, to form the chosen image. Thus, each of the one or more printing stations may print a respective portion of the image. The print heads may be coupled to reduce mechanical complexity within the print stations. However, as described in greater detail above, printing occurs at each of the printing stations within the preset dwell time. The printed fabric product may then be unloaded at the operator station. Optionally, the printed image may be dried, such as in a hot press, prior to unloading. Procedure 1100 then ends at step 1150.

It should be noted that certain steps within procedures 900, 1000, and 1100 may be optional as described above, and the steps shown in FIGS. 9-11 are merely examples for illustration, and certain other steps may be included or excluded as desired. Further, while a particular order of the steps is shown, this ordering is merely illustrative, and any suitable arrangement of the steps may be utilized without departing from the scope of the embodiments herein. Moreover, while procedures 900, 1000, and 1100 are described separately, certain steps from each procedure may be incorporated into each other procedure, and the procedures are not meant to be mutually exclusive.

Advantageously, the techniques herein provide for high-turnaround, closed-loop, direct to garment printing, producing a high quality printed fabric product in a short period of time. In particular, the techniques herein are faster at producing quality printed garments at scale than current systems (e.g., 300 per hour or more), while still remaining high quality and high resolution, yet only requiring a single operator for use, from start (inserting an untreated garment) to finish (removing the printed product) in a "wet-to-dry-to-wet" single-system serial process. Furthermore, the image resolution provided by the techniques herein may be better than conventional wet-on-wet systems, since there is no mixing or smearing of the inks with the pretreatment solution. Other advantages, such as contemporaneous tag printing, reduced pretreatment areas (e.g., pretreating only where needed based on the selected image), automatic system control (e.g., algorithms to adjust phases of the process based on various inputs and correlated functionalities), and many others may also be attained according to the techniques described above.

While there have been shown and described illustrative embodiments that provide for high-turnaround, closed-loop, direct to garment printing, it is to be understood that various other adaptations and modifications may be made within the scope of the embodiments herein. For example, the embodiments may be used in a variety of types of fabric printing, such as canvas, towels, sheets, pillows, and many other fabric types and functions, and the techniques herein need not be limited to the illustrative garment implementations as shown. Furthermore, while the embodiments may have been demonstrated with respect to certain configurations, physical orientations, or system component form factors, other configurations may be conceived by those skilled in the art that would remain within the contemplated subject matter of the description above. In particular, the foregoing description has been directed to specific embodiments. It will be apparent, however, that other variations and modifications may be made to the described embodiments, with the attainment of some or all of their advantages.

Notably, it is expressly contemplated that certain components and/or elements described herein can be implemented as software being stored on a tangible (non-transitory) computer-readable medium (e.g., disks/CDs/RAM/EEPROM/etc.) having program instructions executing on a computer, hardware, firmware, or a combination thereof.

Additionally, the certain aspects of the system described herein may be performed by (or in conjunction with) a computing device having one or more network interfaces (e.g., wired, wireless, etc.), at least one processor, and a memory. The network interface(s) may contain the mechanical, electrical, and signaling circuitry for communicating data to computer networks (e.g., local area networks, the Internet, etc.). The memory comprises a plurality of storage locations that are addressable by the processor for storing software programs and data structures associated with the embodiments described herein. The processor may comprise hardware elements or hardware logic adapted to execute the software programs and manipulate the data structures. An operating system, portions of which is typically resident in memory and executed by the processor, functionally organizes the device by, among other things, invoking operations in support of software processes and/or services executing on the device. These software processes and/or services may illustratively include one or more control processes, user interface processes, system maintenance processes, point of sale collaboration processes, and so on, for performing one or more aspects of the techniques as described herein.

Illustratively, the techniques described herein may be performed by hardware, software, and/or firmware (such as in accordance with the various processes of a computing device local to or remote from the system), which may contain computer executable instructions executed by processors to perform functions relating to the techniques described herein. It will be apparent to those skilled in the art that other processor and memory types, including various computer-readable media, may be used to store and execute program instructions pertaining to the techniques described herein. Also, while the description illustrates various processes, it is expressly contemplated that various processes may be embodied as modules configured to operate in accordance with the techniques herein (e.g., according to the functionality of a similar process). Further, while the processes may be operational separately, or on specific devices, those skilled in the art will appreciate that processes may be routines or modules within other processes, and that various processes may comprise functionality split amongst a plurality of different devices (e.g., client/server relationships).

Accordingly this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. A method of direct-to-garment printing, comprising:

receiving (1) an image input indicative of an image to be printed onto a garment, and (2) a fabric input indicative of a garment fabric type;

determining one or more printing conditions based on the image input and the fabric input;

determining a printing time, based on the one or more printing conditions;

determining a rate limiting step for the direct-to-garment printing process based on the printing time; and calculating a preset dwell time for a plurality of pallets to stop at a plurality of stations along a closed-loop path, wherein (a) the plurality of pallets are movable along the closed-loop path, each pallet configured to secure a fabric substrate having a printable surface, and (b) the plurality of stations along the closed loop path comprise at least: an operator station configured for receiving and securing the fabric substrate onto one of the plurality of pallets, and one or more printing stations configured for printing an image on the printable surface.

2. The method of claim 1, wherein the image input comprises color, size, or resolution of the image.

3. The method of claim 1, wherein the fabric input comprises fabric materials, fabric thickness or fabric size.

4. The method of claim 1, wherein the one or more printing conditions comprises a number of print passes, number and type of print head, ink composition, or pretreatment conditions.

5. The method of claim 1, wherein the one or more printing conditions and information about the image to be printed on the garment are provided to a printer, which is used to determine the printing time.

6. The method of claim 5, wherein the printer is a color printer.

7. The method of claim 1, further comprising determining a number and types of the plurality of stations along the closed-loop path to utilize based on the printing time.

8. The method of claim 1, wherein the image input comprises target location of the image on the fabric substrate, which affects the printing time.

9. The method of claim 1, wherein the one or more printing stations comprise at least a white ink printing station and a color ink printing station.

10. The method of claim 9, wherein at least one color ink printing station is configured to print a color image over a white image printed by the white ink printing station.

11. The method of claim 1, wherein the plurality of stations comprises at least a pretreatment station configured for pretreating at least a portion of the printable surface of the fabric substrate with a pretreatment fluid.

12. The method of claim 11, wherein an amount of pretreatment, type of pretreatment solution or method of application is selected based on the image input or fabric input.

13. The method of claim 1, wherein the operator station is further configured for unloading the printed fabric from the pallet.

14. The method of claim 1, wherein the plurality of pallets are movable in tandem along the closed-loop path.

15. A printed fabric product, prepared by the direct-to-garment printing process of claim 1.

16. An apparatus for direct-to-garment printing, comprising:

(a) a control system configured to:

(i) receive (1) an image input indicative of an image to be printed onto a garment, and (2) a fabric input indicative of a garment fabric type;

(ii) determine one or more printing conditions based on the image input and the fabric input;

(iii) determine a printing time, based on the one or more printing conditions;

(iv) determine a rate limiting step for the direct-to-garment printing process based on the printing time; and (v) calculate a preset dwell time for a plurality of pallets to stop at a plurality of stations along a closed-loop path, wherein (a) the plurality of pallets are movable along the closed-loop path, each pallet configured to secure a fabric substrate having a printable surface, and (b) the plurality of stations along the closed loop path comprise at least: an operator station configured for receiving and securing the fabric substrate onto one of the plurality of pallets, and one or more printing stations configured for printing an image on the printable surface; and (b) the plurality of stations arranged along the closed-loop path.

17. The apparatus of claim 16, wherein the control system is further configured to coordinate movement of the plurality of pallets between the plurality of stations.

18. The apparatus of claim 16, wherein the one or more printing conditions comprises a number of print passes, number and type of print head, ink composition, or pretreatment conditions.

19. The apparatus of claim 16, wherein the one or more printing conditions and information about the image to be printed on the garment are provided to a printer, which is used to determine the printing time.

20. The apparatus of claim 16, wherein the image input comprises color, size, resolution, and target location of the image.

* * * * *